US006301810B1

(12) United States Patent
Fidler

(10) Patent No.: US 6,301,810 B1
(45) Date of Patent: Oct. 16, 2001

(54) HAMMERLESS MECHANICALLY ATTACHED ADAPTER SYSTEM

(75) Inventor: Jerry D. Fidler, Mossville, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/411,611

(22) Filed: Oct. 1, 1999

(51) Int. Cl.[7] ..... E02F 9/28
(52) U.S. Cl. ..... 37/458; 37/455
(58) Field of Search ..... 37/457, 458, 455

(56) References Cited

U.S. PATENT DOCUMENTS

| | | | | |
|---|---|---|---|---|
| 2,547,789 | | 4/1951 | Skeel . | |
| 3,812,608 | | 5/1974 | Ratkowski | 37/141 T |
| 3,831,297 | | 8/1974 | Lanz et al. . | |
| 4,057,294 | | 11/1977 | Krekeler . | |
| 4,357,765 | | 11/1982 | Seykora | 37/142 R |
| 4,433,496 | | 2/1984 | Jones et al. | 37/141 R |
| 5,410,826 | * | 5/1995 | Immel et al. | 37/457 |
| 5,438,774 | | 8/1995 | Fletcher et al. | 37/456 |
| 5,452,529 | * | 9/1995 | Neuenfeldt et al. | 37/455 |
| 5,564,206 | * | 10/1996 | Ruvang | 37/458 |
| 5,638,621 | | 6/1997 | Keech et al. . | |
| 5,718,070 | * | 2/1998 | Ruvang | 37/459 |
| 5,784,813 | | 7/1998 | Balassa et al. | 37/455 |
| 5,868,518 | | 2/1999 | Chesterfield et al. . | |

FOREIGN PATENT DOCUMENTS 6448396 3/1997 (AU) .

* cited by examiner

*Primary Examiner*—Robert E. Pezzuto
*Assistant Examiner*—Kristine M Markovich
(74) *Attorney, Agent, or Firm*—O. Gordon Pence

(57) ABSTRACT

A hammerless mechanical attachment system comprising a C-clamp member, a first wedge member, a second wedge member and a threaded tensioning device for attaching a tooth adapter to a base cutting edge of an implement. The C-clamp member has a generally C-shaped body with a forwardly facing abutment surface and a forwardly extending flange having a threaded aperture therein. The first wedge member has a forward side having a first wedge surface thereon, an opposite rearward side having a second abutment surface thereon positionable against the first abutment surface of the C-clamp member, and a through bolt hole disposed along a longitudinal axis parallel to the second abutment surface. The bolt hole is disposed in alignment with the threaded aperture in the flange when the second abutment surface is placed in abutment with the first abutment surface of the C-clamp. The second wedge member has a rearwardly facing side having a second wedge surface thereon and a forwardly facing side having a third abutment surface thereon. The second wedge surface is positionable in abutting relationship with the first wedge surface of the first wedge member. The threaded tensioning device is disposed through the bolt hole in the first wedge member and threadably engaged with the threaded aperture in the flange of the C-clamp member, whereby the second wedge member is caused to move in a forward direction upon tightening of the threaded tensioning device for securing the adapter to the base edge.

7 Claims, 2 Drawing Sheets

HAMMERLESS MECHANICALLY ATTACHED ADAPTER SYSTEM

TECHNICAL FIELD

This invention relates generally to a tooth adapter for an implement and more particularly to a hammerless mechanical attachment system for attaching an adapter to the base edge of the implement.

BACKGROUND ART

Tooth adapters are commonly used to detachably mount a digging tooth or tip to a bucket or similar implement. Such tooth adapters are carried on the base edge of the bucket. In the past, tooth adapters were simply welded to the base edge of the bucket. While the use of welding as an attachment mechanism was effective, such welding made the replacement of the adapter difficult and time consuming. More recently, various ways of mechanically attaching such adapters have been employed in order to reduce the time and costs of replacing tooth adapters when they either break or become worn out. One of such ways is where the adapter is bolted to the base edge of a bucket. However, it is frequently difficult to remove the bolts after normal use because of the wearing away of the bolt head. Additionally, as the components increase in size, it is more difficult to get bolts large enough and/or to apply sufficient torque to properly tighten the bolts. Furthermore, the bottom of the bucket is subject to high wear. As a consequence, the nut and bolt-end are prematurely worn away, allowing the adapter to come loose and fall off.

In other type of attachment system, a C-shaped clamp member is vertically inserted through slots in upper and lower straps of an adapter and through a similar slot in the base edge. Such C-clamp is held in place by hammering a wedge in-between the C-clamp and edge of the slot in the base edge. In view of the size of the components used on very large buckets, a large amount of effort must be expended in hammering the wedge. Also, the wedges may become loose prematurely, resulting in the adapter falling off the bucket, or the wedge may become very difficult to remove due to corrosion or dirt impacting around the components, requiring the adapter to cut off with an oxy-acetylene torch.

To eliminate the need for hammering one wedge against another wedge, others have employed a bolt as a tensioning device in a wedge type retainer to draw and secure the wedges together. One such device is disclosed in U.S. Pat. No. 5,410,826 issued May 2, 1995 to Darryl R. Immel et. al. Another such device is disclosed in U.S. Pat. No. 4,433,496 issued Feb. 28, 1984 to Larren F. Jones et. al. that employs an arcuate camming wedge. In both such attempts however, the tensioning bolt is coupled between the two wedge members. Because of the lateral shifting of the wedges as they are drawn together, a bending force is exerted on the bolt or the bolt head is caused to be tightened against a surface that is cocked relative to the head. Such conditions may result in the loosening of the bolt during use and the subsequent loss of the retaining device and the adapter.

The present invention is directed to overcoming one or more of the problems as set forth above.

DISCLOSURE OF THE INVENTION

In one aspect of the present invention, a hammerless mechanical attachment system is provided for attaching a tooth adapter to a base cutting edge of an implement. Such attachment system includes a C-clamp member, a first wedge member, a second wedge member and a threaded tensioning device. The C-clamp member has a generally C-shaped body with a forwardly facing abutment surface and a forwardly extending flange having a threaded aperture therein. The first wedge member has a forward side having a first wedge surface thereon, an opposite rearward side having a second abutment surface thereon positionable against the first abutment surface of the C-clamp member, and a through bolt hole disposed along a longitudinal axis parallel to the second abutment surface. The bolt hole is disposed in alignment with the threaded aperture in the flange when the second abutment surface is placed in abutment with the first abutment surface of the C-clamp.

The second wedge member has a rearwardly facing side having a second wedge surface thereon and a forwardly facing side having a third abutment surface thereon. The second wedge surface is positionable in abutting relationship with the first wedge surface of the first wedge member.

The threaded tensioning device is disposed through the bolt hole in the first wedge member and threadably engaged with the threaded aperture in the flange of the C-clamp member, whereby the second wedge member is caused to move in a forward direction upon tightening of the threaded tensioning device for securing the adapter to the base edge.

The present invention provides a hammerless mechanical attachment system that eliminates bending forces on the tensioning bolt or the misalignment between the mounting holes for such tensioning bolt due to relative lateral movement between the wedge members of prior devices as the tensioning bolt is tighten to secure the adapter to the cutting edge.

BEST MODE FOR CARRYING OUT THE INVENTION

Figure 1:
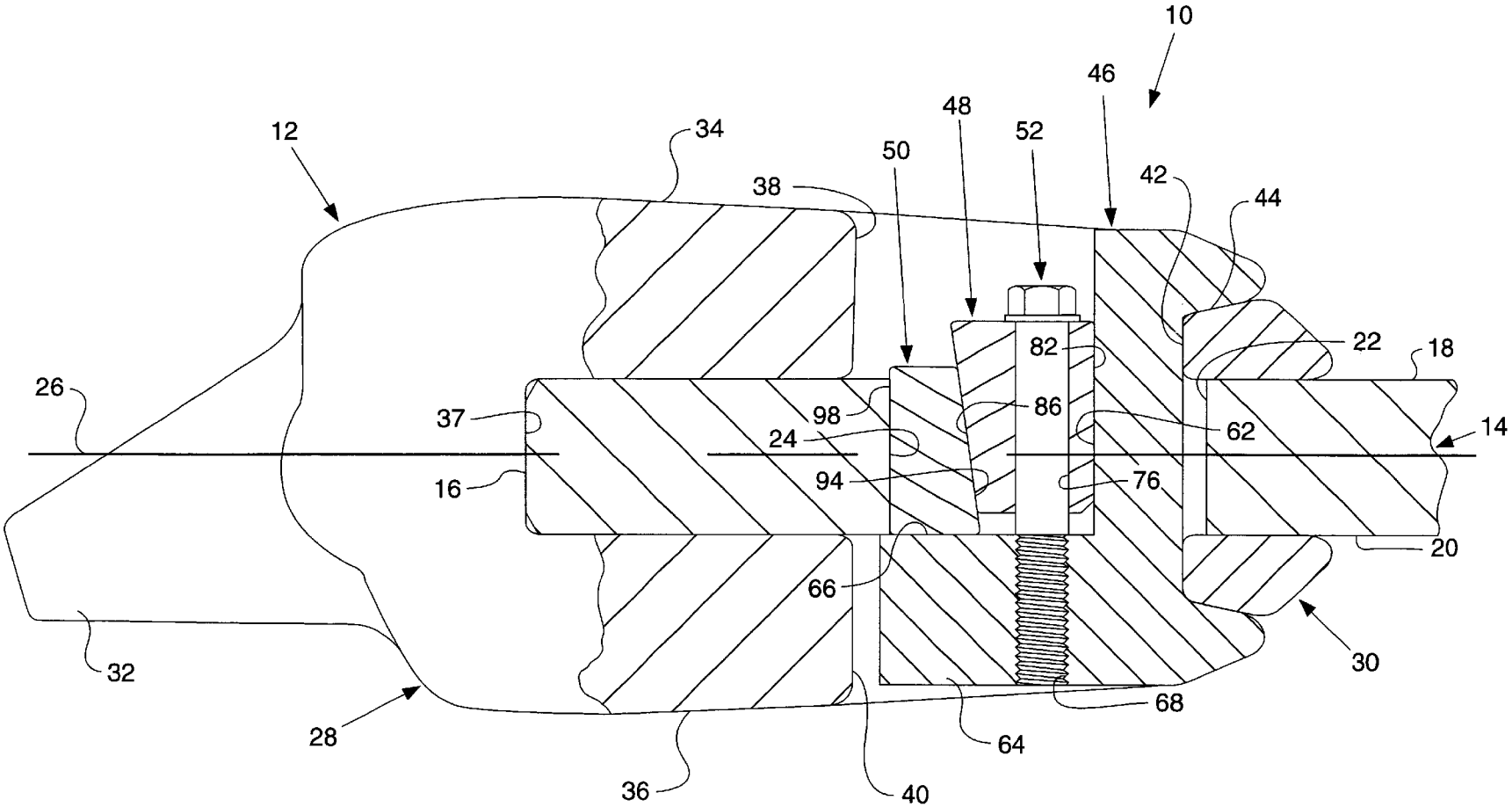
FIG. 1 is a fragmentary partially cross-sectional view of a tooth adapter shown mounted on a base cutting edge for an implement and illustrating an embodiment of the present hammerless mechanical attachment system invention.
Figure 2:
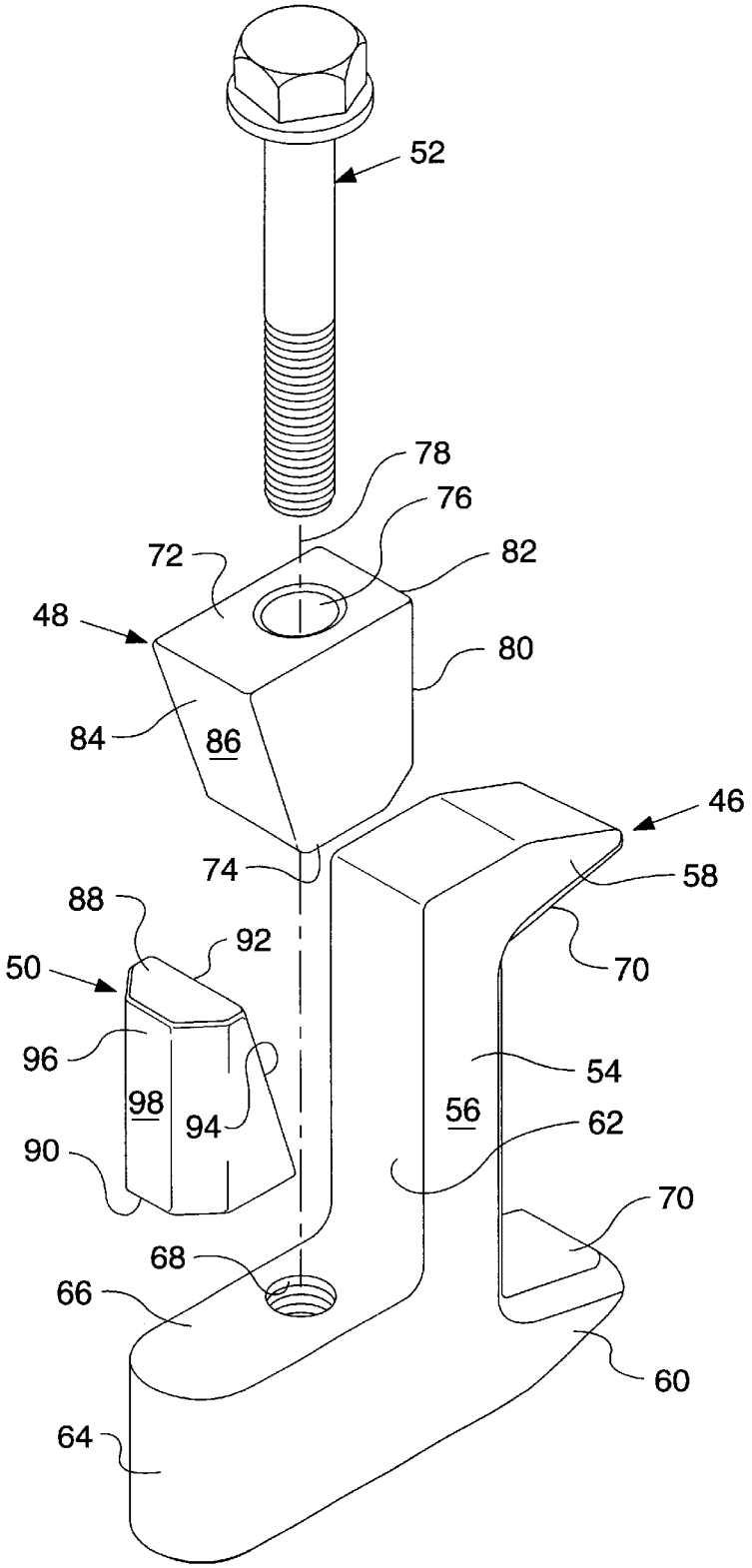
FIG. 2 is an exploded prospective view of the components of the attachment system illustrated in FIG. 1

Referring to the drawings, a hammerless mechanical attachment system 10 is disclosed for attaching a tooth adapter 12 to a base cutting edge 14 of an implement, such as a loader, dragline or excavator bucket (not shown). The base cutting edge 14 includes a leading edge 16, an upper surface 18, a lower surface 20 generally parallel with the upper surface 18 and is provided with a series of elongated slots, one of which is shown at 22. The elongated slot 22 is spaced from the leading edge 16, extends between the upper surface 18 and the lower surface 20 and has its elongate axis oriented generally perpendicular to the leading edge 16 and has an abutment surface 24 at its end adjacent the leading edge 16.

The tooth adapter 12 is constructed for mounting on the base cutting edge 14. The adapter 12 has a forward tooth mounting end portion 28 and a bifurcated rearward end portion 30. The forward tooth mounting end portion 28 has a nose 32 adapted to receive and detachably mount a digging tooth (not shown). It should be recognized that the forward tooth mounting end portion 28 could be in the form of a tooth without departing from the essence of the invention. The bifurcated end portion 30 has a rearwardly extending upper strap 34 positionable along the upper surface 18 of the base edge 14 and a rearwardly extending lower strap 36 positionable along the lower surface 20 thereof. An abutment surface 37 is provided between and connects the proximal ends of the upper and lower straps 34,36. Upper strap 34 is provided with a first elongated slot 38, while the lower strap 36 is provided with a second elongated slot 40 aligned with the first slot 38. When the adapter 12 is properly mounted onto the base edge 14, the first and second slots 38,40 are also disposed in general alignment with the elongate slot 22 in the base edge 14 when the abutment surface engages the leading edge 16 of the base edge 14. Each of the first and second slots 38,40 is provided with a rearward end 42 adjoining a tapered groove 44.

The hammerless mechanical attachment system 10 includes a C-clamp member 46, a first wedge member 48, a second wedge member 50 and a threaded tensioning device or bolt fastener 52. The C-clamp member 46 includes a generally C-shaped body 54 having an upright leg 56 and a pair of spaced apart, rearwardly extending tapered clamping arms 58,60, each tapered clamping arm 58,60 extending from a respective one of the opposite ends of the upright leg 56. The C-clamp member 46 also includes a forwardly facing abutment surface 62 and a forwardly extending flange 64 having a upper surface 66 adjoining and disposed in a perpendicular relationship to the forwardly facing surface 62. A threaded aperture 68 is provided in the flange 64. Each of the tapered clamping arms 58,60 are positionable within a respective one of the tapered grooves 44 in the upper and lower straps 34,36.

The first wedge member 48 has a top end 72 and a bottom end 74, with a through bolt hole 76 disposed along a longitudinal axis 78 from the top to the bottom ends 72,74. The first wedge member 48 also has rearward side 80 having a second abutment surface 82 disposable along the forwardly facing first abutment surface 62 of the C-clamp member 46 and an opposite forward side 84 having a first wedge surface 86 thereon. The bolt hole 76 is disposed in alignment with the threaded aperture 68 in the flange 64 when the second abutment surface 82 is placed in abutment with the first abutment surface 62 of the C-clamp 46. The second abutment surface 82 is substantially parallel to the longitudinal axis 78 of the bolt hole 76. The first wedge surface 86 is in a non-parallel relationship to the longitudinal axis 78 and angles upwardly and outwardly (forwardly) from the bottom end 74.

The second wedge 50 similarly has a top end 88 and a bottom end 90, with the bottom end 88 being positionable against the upper surface 66 of the flange 64 of the C-clamp 46. The second wedge 50 also has a rearwardly facing side 92 having a wedge surface 94 thereon and a forwardly facing side 96 having a third abutment surface 98 thereon. The wedge surface 94 angles upwardly and inwardly from the bottom end 90 in a parallel and abutting relationship to the first wedge surface 86 of the first wedge. The front third abutment surface is adapted to abut the abutment surface 24 at the forward end of the elongate slot 22 in the base edge 14.

Industrial Applicability

To assembly the adapter onto the base edge 14, the adapter is positioned on the base edge 14 such that the base edge 14 is received between the upper and lower straps 34,36 of the adapter 12 and such that the first and second slots 38,40 of the straps align with one of the elongate slots 22 in the base edge 14.

The construction of the present attachment system 10 enables the secure attachment of the adapter 12 to the cutting edge 14 without the use of a hammer commonly required for wedge and C-clamp devices of the past. In particular, the C-clamp 46 is placed through the slots 38,40 of the straps of the adapter and the slot 22 in the base edge such that the rearwardly extending tapered clamping arms 58,60 extend into the tapered grooves 44 of the upper and lower straps 34,36, respectively. The engagement of the tapered surfaces 70 on the tapered clamping arms 58,60 with their respective tapered grooves ensures a tight fitting relationship between the C-clamp 46 and the adapter 12. Next, the second wedge member 50 can be inserted through the slot 38 of the upper strap 34 and into the slot 22 of the base edge 14 such that the bottom end 90 of wedge member 50 abuts the upper surface 66 of flange 64 and the third abutment surface in disposed against the abutment surface 24 of the elongate slot 22 in the base edge 14. With the second wedge in place, the first wedge can be inserted such that its first wedge surface 86 is disposed along the wedge surface 94 of the second wedge 50 and its second abutment surface is disposed along the first abutment surface 62 of the C-clamp 46. With the components thus in place, the bolt 52 can be inserted through the bolt hole 76 of the first wedge and into the threaded aperture 68 of the C-clamp. Tightening the bolt pulls the first wedge down against the second wedge 50, causing the C-clamp 46 to move rearwardly due to the wedging action between the wedge surfaces 86,94, which, in turn, pulls the adapter rearwardly until the abutment surface 37 tightly engages the leading edge 16 of the base edge 14. A sufficient amount of tightening torque is applied to the bolt 52 to cause a predetermined amount of bolt stretch, which is effective in ensuring that the bolt 52 does not become loose during use and that the adapter 12 remains tight on the base edge 14.

Of particular importance in the construction of the present invention is that the tightening of the bolt 52 and the resultant lateral movement of the C-clamp 46 does not cause any cocking of the bolt 52 or the misalignment between the bolt 76 and the threaded aperture 68. This is due to the fact that movement of the first wedge due to tightening of the bolt 52 is solely along the longitudinal axis 78 of the bolt hole 76, and there is no movement in a transverse direction thereto.

It should also be noted that the size (or the fore to aft dimension) of the second wedge 50 is selected to ensure that the abutment surface 37 on the adapter 12 is full abutting engagement with the leading edge 16 of the base cutting edge 14 before the bottom end 74 of the first wedge 48 seats against the flange 64 of the C-clamp member 46, thus ensuring that the adapter 12 is securing held onto the base edge 14. In order to accommodate variations in tolerances in the parts and wear, various sizes of the second wedge 50 may be provided so that the appropriate size may be selected during the assembly of the adapter and its retention by the present hammerless mechanically attached adapter system.

Other aspects, objects and advantages of this invention can be obtained from a study of the drawings, the disclosure and the appended claims.

What is claimed is:

1. A hammerless mechanical attachment system for attaching a tooth adapter to a base cutting edge of an implement, said hammerless mechanical attachment system comprising:

a C clamp member having a generally C-shaped body with a forwardly facing abutment surface and a forwardly extending flange having a threaded aperture therein;

a first wedge member having a forward side having a first wedge surface thereon, an opposite rearward side having a second abutment surface thereon positionable against said first abutment surface of said C clamp member, and a through bolt hole disposed along a longitudinal axis parallel to said second abutment surface but in a non-parallel relationship to said first wedge surface, said bolt hole being disposed in alignment with said threaded aperture in the flange when the second abutment surface is placed in abutment with said first abutment surface of the C-clamp;

a second wedge member having a rearwardly facing side having a second wedge surface thereon and a forwardly facing side having a third abutment surface thereon, said second wedge surface being positionable in abutting relationship with said first wedge surface of said first wedge member; and a threaded tensioning device disposed through said bolt hole in said first wedge member and threadably engaged with said threaded aperture in said flange of said C-clamp member, whereby said second wedge member is caused to move in a forward direction upon tightening of said threaded tensioning device for securing said adapter to said base edge.

2. The hammerless mechanical attachment system of claim 1 wherein said first wedge member has a top end and a bottom end and wherein said first wedge surface angles outwardly from the bottom end toward said top end.

3. The hammerless mechanical attachment system of claim 2 wherein said second wedge member has a top end and a bottom end and wherein second wedge surface thereon angles upwardly and inwardly from said bottom end toward said top end.

4. The hammerless mechanical attachment system of claim 3 wherein said forwardly extending flange of said C-clamp member has a upper surface disposed in a perpendicular relationship to said first abutment surface thereon, and wherein said bottom end of said second wedge member is positionable against said upper surface.

5. The hammerless mechanical attachment system of claim 4 wherein said base cutting edge has a leading edge and an elongate slot, said slot being spaced from said leading edge and an end adjacent said leading edge defining a fourth abutment surface, and wherein said third abutment surface of said second wedge is positionable in abutting engagement against said fourth abutment surface.

6. The hammerless mechanical attachment system of claim 5 wherein said adapter includes a rearwardly extending upper strap and a rearwardly extending lower strap, said upper strap having a first elongated slot, while the lower strap is provided with a second elongated slot, the first and second slots each having a rearward end and each being disposed in general alignment with said elongate slot in the base edge, and wherein said C-clamp member is positionable in said slots and adapted to engage said upper and lower straps at the rearward ends of said first and second slots in said straps.

7. A hammerless mechanical attachment system for attaching a tooth adapter to a base cutting edge of an implement, said base cutting edge having a leading edge and an elongated slot spaced from the leading edge, said slot having an abutment surface at its end adjacent the leading edge, said adapter having a bifurcated rearward end portion having a rearwardly extending upper strap positionable along the upper surface of the base edge and a rearwardly extending lower strap positionable along the lower surface thereof, said upper strap having a first elongated slot, while the lower strap is provided with a second elongated slot aligned with the first slot such that when the adapter is properly mounted onto the base edge, the first and second slots are also disposed in general alignment with said elongate slot in the base edge, said hammerless mechanical attachment system comprising:

a C-clamp member having a generally C-shaped body with a forwardly facing first abutment surface, a forwardly extending flange with a upper surface adjoining and disposed in a perpendicular relationship to the forwardly facing first abutment surface, and a threaded aperture in said flange;

a first wedge member having a top end and a bottom end, with a through bolt hole disposed along a longitudinal axis from the top to the bottom ends, a rearward side having second abutment surface disposable along said forwardly facing first abutment surface of said C-clamp member, and an opposite forward side having a first wedge surface thereon, said bolt hole being disposed in alignment with said threaded aperture in the flange when the second abutment surface is placed in abutment with said first abutment surface of the C-clamp, said second abutment surface being substantially parallel to the longitudinal axis of the bolt hole;

a second wedge member having a top end and a bottom end, with the bottom end being disposable in abutting relation to the upper surface of the flange of the C-clamp, said second wedge also having a rearwardly facing side having a second wedge surface thereon and a forwardly facing side having a third abutment surface thereon, said second wedge surface being positionable in abutting relationship to the first wedge surface of the first wedge, said third abutment surface being adapted to abut the abutment surface at the forward end of the elongate slot in the base edge; and a threaded tensioning device disposed through said bolt hole in said first wedge member and threadably engaged with said threaded aperture in said flange of said C-clamp member, whereby second wedge member is caused to move in a forward direction upon tightening of said threaded tensioning device for securing said adapter to said base edge.

* * * * *